United States Patent [19]

Suroff

[11] 4,023,579

[45] May 17, 1977

[54] ULTRASONIC TREATMENT OF HAIR

[75] Inventor: Leonard W. Suroff, Jericho, N.Y.

[73] Assignee: Xygiene, Inc., Panama, Panama

[22] Filed: May 17, 1976

[21] Appl. No.: 687,331

[52] U.S. Cl. ..... 132/9; 34/4

[51] Int. Cl.[2] ..... A45P 1/04

[58] Field of Search ..... 132/9; 34/4, 3

[56] References Cited

UNITED STATES PATENTS

| | | | |
|---|---|---|---|
| 3,175,299 | 3/1965 | Boucher | 34/4 |
| 3,281,948 | 11/1966 | Goble | 34/3 |

*Primary Examiner*—G.E. McNeill

[57] ABSTRACT

The treating of hair on the human head is obtained by providing a cylindrical shaped support member capable of transmitting ultrasonic vibrations in a radial mode and placing hair around the support member to receive vibrations transmitted thereto. A cover is disposed substantially around the support member as an ultrasonic transducer adapted to produce radially directed vibrations is positioned within the support member. A treatment fluid is simultaneously supplied to the hairs supported on the support member, and by energizing the transducer ultrasonic vibrations are radially transmitted through the support member for treatment of the hair with the cover substantially retaining the fluid around the support member.

65 Claims, 3 Drawing Figures

ULTRASONIC TREATMENT OF HAIR

BACKGROUND OF THE INVENTION

1. Field of the Invention

The present invention relates to improved method and apparatus for treating hair with ultrasonic vibrations.

2. Description of the Prior Art

The utilization of vibratory energy for the treatment of hair has been proposed in U.S. Pat. Nos. 3,211,159 and 3,526,234. The prior art teachings as contained in the above two referenced patents have not been brought to commercial utilization because they do not lend themselves to be implemented in a practical manner.

Taking into consideration the habits of the female as well as male population in hair care, the acceptance of new procedures to properly produce the desired cosmetic effect should be as normal as present procedures, such that a minimal amount of new techniques must be accomplished or learned.

OBJECTS OF THE INVENTION

An object of the present invention is to provide an ultrasonic device adapted for consumer use in the treatment of hair.

Another object of the present invention is to provide an improved method and apparatus for treating of hair with ultrasonic vibrations radially directed to specially designed rollers that act to support the hair during treatment.

Another object of the present invention is to provide a home care hair treatment system including a plurality of hair support members that may be individually vibrated with ultrasonic energy for treatment of the human hair.

Other objects and advantages of the present invention will become apparent as the disclosure continues.

SUMMARY OF THE INVENTION

The outstanding and unexpected results obtained by the practice of the method and apparatus of this invention are attained by a series of features, steps, and elements assembled working together in inter-related combination.

The present invention for treating hair on the human head includes cylindrical shaped support means including a support member capable of transmitting ultrasonic vibrations in a radial mode, and on which the hair is placed around the support member to receive vibrations transmitted thereto. Housing means adapted to be hand held is provided with cover means extending from one end thereof in spaced relation to ultrasonic transducer means adapted to produce radially directed vibrations in the support member when positioned axially within the support member. A treatment fluid is supplied to the hairs supported on the support member, and the ultrasonic transducer is vibrated radially when in acoustically assembled relation with a support member for treatment of the hair in surrounding relation thereto. The cover means acts to substantially retain the fluid around the support member.

The hair treatment device further includes reflecting means associated with the cover means to reflect the mechanical vibratory energy transmitted through the support member into the hair. The positioning of the ultrasonic transducer within each support member is accomplished by retaining the support member in a relatively fixed position, and vibrating the ultrasonic transducer simultaneously during the insertion within the support member to reduce the coefficient of friction therebetween to obtain maximum acoustical coupling between the transducer and the support member. The same procedure during withdrawal from within the support member is also followed. To facilitate the contacting surfaces of the transducer and the support member to obtain insertion and removal therebetween they may be tapered, as well as the mating surfaces between the support member and the cover means.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views in which:

DETAILED DESCRIPTION OF THE DRAWINGS

Figure 1:
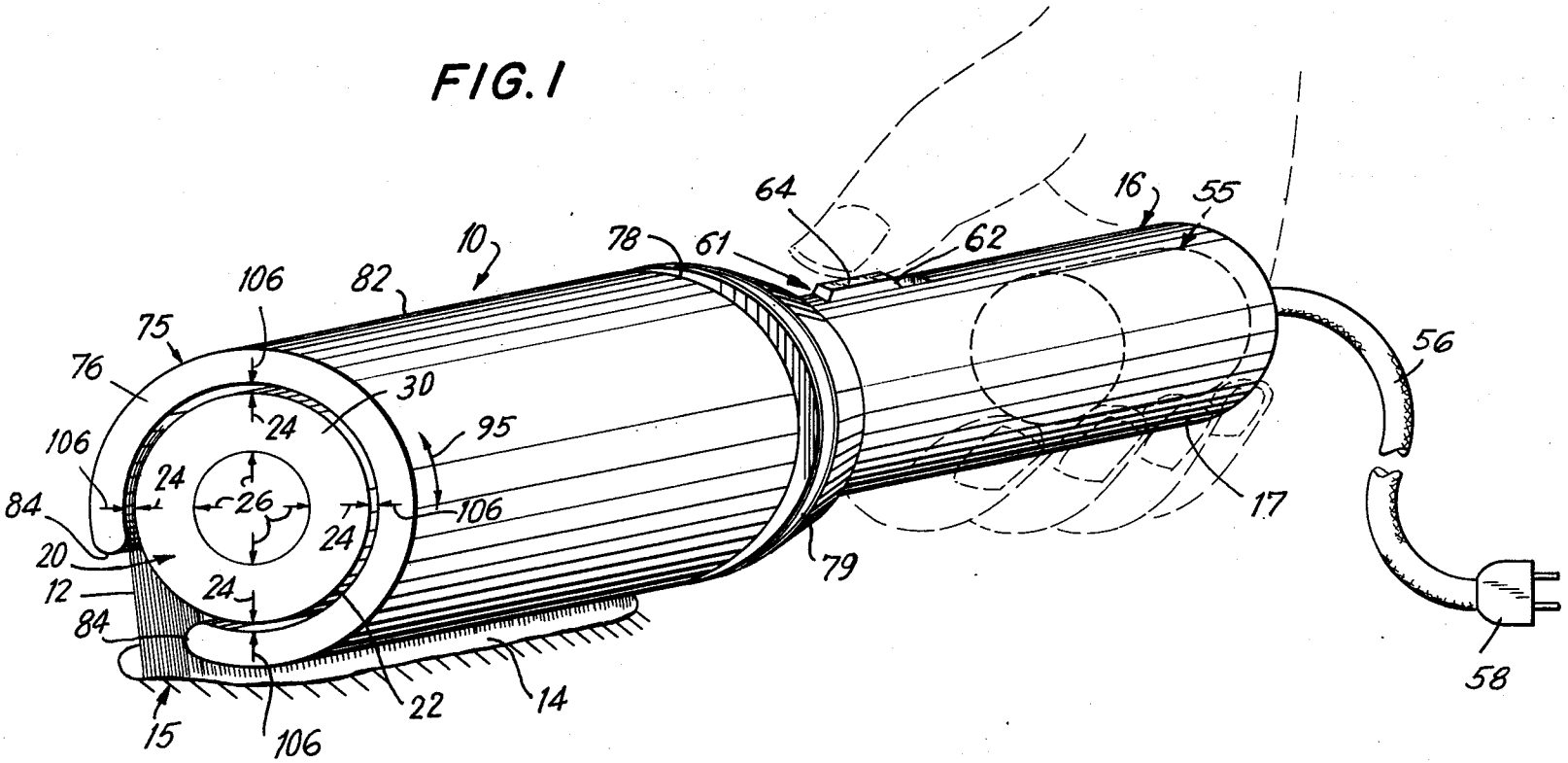
FIG. 1 is a perspective view of the ultrasonic hair treatment device embodying the invention.
Figure 2:
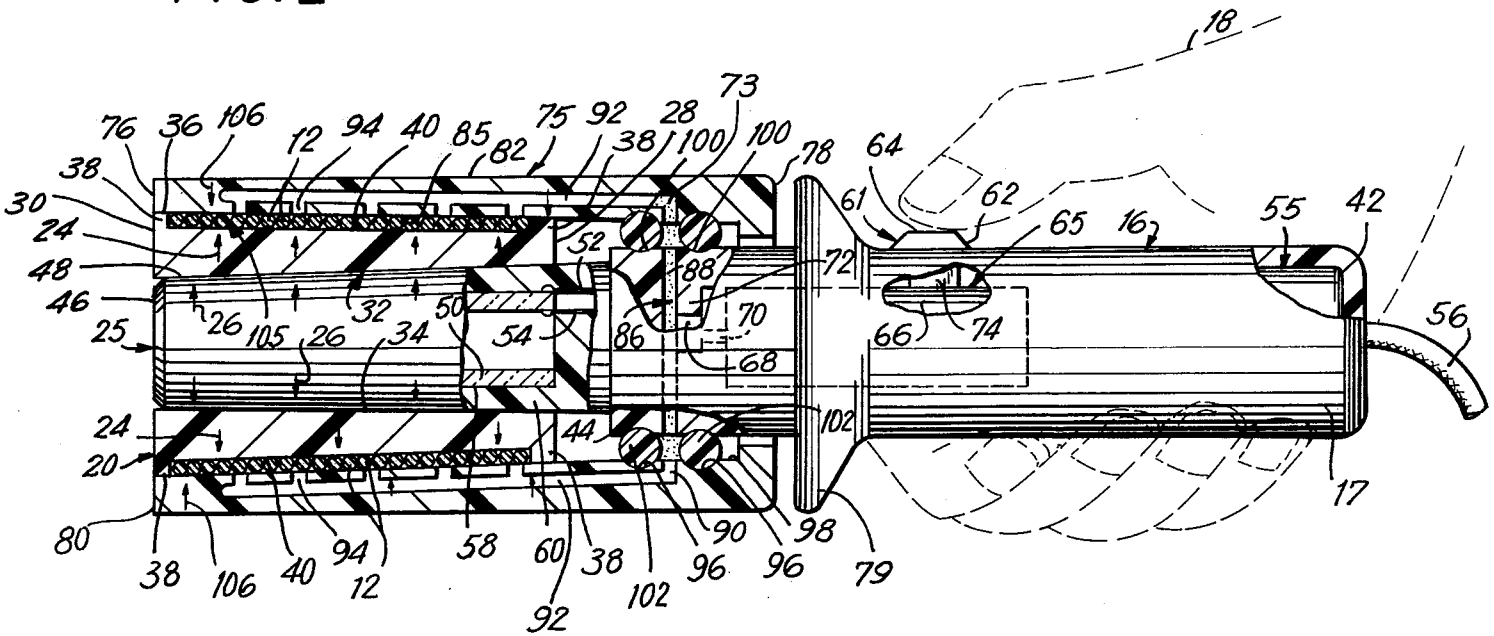
FIG. 2 is a longitudinal sectional view of the device.

Referring now to the drawings, FIGS. 1 and 2 thereof illustrate an ultrasonic device or appliance 10 for treating of human or synthetic hair 12 that is extending outwardly from the scalp 14 of the user or individual 15 having their hair treated. The device 10 is designed to permit the user 15 thereof, or some other person assisting the person receiving the ultrasonic hair treatment, to use the device 10 in a simple, efficient manner, without modifying their particular habits in setting their hair prior to treatment. The portable device 10 includes elongated housing means 16 having a handle portion 17 adapted to be held or gripped by the fingers 18 of the user 15 of the device 10.

To be used in conjunction with the device 10 are a plurality of tubular or cylindrical shaped supporting means 20, in the form of rollers, that include a body portion or support member 22 capable of receiving and transmitting ultrasonic mechanical vibrations, in a radial mode as illustrated by the arrows 24. Transducer means 25 extends axially from one end of said housing means 16 and is adapted to produce radially directed vibrations in the direction of arrows 26 to excite the support member 22 in a radial mode.

Each support member 22 may be made out of a plastic material and including a front end 28, a rear end 30 in spaced apart relation thereto, and an axially extending chamber or bore 32 having an inner wall or surface 34 that may extend longitudinally the length of the support member 22 between the respective end walls 28 and 30. The support member 22 further includes an outer or peripheral wall 36 that includes a pair of outwardly extending spaced apart ribs 38 approximately at each end wall 28 and 30, respectively, of the support member 22. The ribs 38 function as the retaining means for keeping the hair 12 on each support member. The support member 22 also includes a circumferential groove or recess 40 between th ribs 38 for receiving the strands of hair 12 therein.

The transducer means 25 extends axially from the housing means 16 which includes a housing member 42 forming the handle portion 17, that is adapted to be easily grasped by the user. The housing member 42 has a front end 44 and a rear end 45. The transducer means may terminate in a forward end 46 that may be in alignment with the rear wall 30 of the support member 22. The transducer means 25 extends outwardly from the front end 44 of the housing member 42 which is designed such that the transducer means 25 may be axially insertable and retractible from within the bore 32 of the support member 22 after the hair 12 has been wound around the support means 20 in a conventional manner by the user.

The radial vibrations 26 produced by the transducer means 25 are transmitted from the outer cylindrically shaped output surface or wall 48 of the transducer means 25 such that the support member 22 is in turn excited in its radial mode and caused to vibrate radially in the direction of arrows 24 to impart vibratory mechanical energy to the hair 12 positioned thereon. The support means 20 may vibrate at or near the same frequency as the transducer means 25.

The transducer means 25 may take various shapes and forms, and as illustrated, may include an inner cylindrical or crystal member 50 made of ceramic material such as a piezoelectric element having connected thereto electric leads 52 and 54 that extend into the housing means 16 and electrically connected to generating means 55 which is illustrated as contained within the housing member 42 and in turn connected by an electric cord 56 to a plug 58 adapted to be received within a conventional electrical outlet. The generating means 55 converts conventional electrical current to a high frequency in the ultrasonic range, which for purposes of the present invention is defined as extending between 1,000 to 1,000,000 cycles per second.

The generating means 55 may be of various forms well known in the art and adapted to drive the transducer means 25 by the electrical energy transmitted through leads 52 and 54 to the crystal 50. The dimensions of the cylindrical shaped crystal 50 are selected to produce the radially directed vibrations from the output surface 58 thereof and to transmit these vibrations to the support means 20. The crystal 50 is embedded in a transmission means or holder 60 made of relatively soft material that may be molded into surrounding relation with the crystal 50 to encapsulate the crystal 50 and transmit the vibrations through the holder 60 to the output surface 58. Accordingly, the material of the holder 60 should be of a material having good characteristics for the transmission of ultrasonic mechanical vibration.

The mechanical dimensions of the crystal 50 in conjunction with the holder 60 is selected to produce the radially extending outwardly directed vibrations 26. It is appreciated and well known in the art that the outer output surface 48 of the transducer means 25 will expand and contract at substantially the same frequency at which the crystal 50 radially vibrates. The friction reduction properties of an ultrasonically vibrating member relative to another member has been incorporated in the present invention to facilitate the process of positioning the ultrasonic transducer means 25 within the confines of the bore 32 of the support means 20 and may be utilized in the subsequent step of removing the transducer means 25 from the position illustrated in FIG.2.

Figure 3:
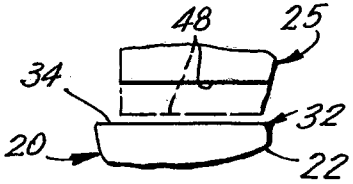
FIG. 3 is a greatly enlarged view illustrating the motion of the vibratory surface of the transducer means.

When the output surface 48 radially vibrates, it is oscillating between a radially expanded and contracted position such that there are moments in which there is no contact between the outer surface 48 and the wall 34 of the bore 32. As illustrated with respect to FIG. 3, the support means 20 has the inner wall 34 of bore 32 extending in opposed relationship to the outer wall 48 of the transducer means 25 with the magnitude of friction reduction in part related to the actual amplitude of vibration illustrated in FIG. 3 between the solid and phantom lines of surface 48. In FIG. 3 the output surface 48 of the transducer means 25 is moving from between the solid line, at the end of a vibratory cycle, to the phantom surface line, at the other end of the vibratory cycle.

At approximately 20,000 cycles per second, at say an amplitude of 0.001 inch, the surface 48 produces peak accelerations of the order of at least 1,000g. and is continuously moving away from the surface 34 of the support member 22 at a quicker rate than the radially vibrating support means 20. In a sense the output surface 48 reaching its peak height is momentarily in contact with the surface 34 of the support means 20. The phenomenon is a unique property of ultrasonic vibratory mechanical energy which can be utilized to initially position the transducer means 25 within the support means 20 to obtain maximum coupling contact therebetween. To obtain the friction reduction effect in accordance with FIG. 3, the transducer means 25 may be longitudinally vibrated along the longitudinal axis during the inserting of the transducer means 25 axially into the bore 32 and thereafter radially vibrated. Thus the transducer means 25 may be designed to be energized in a longitudinal mode at one frequency and in a radial mode at a different frequency or the two transducers could even be provided to form the transducer means.

The present invention in order to produce a consumer device takes into consideration the necessity of coaxially positioning the transducer means 25 within the support means 20 so as to assure maximum coupling of the vibratory energy therebetween. The amplitude of radial vibration of the output surface 48 may be in the range of 0.0001 inch to 0.010 inch and at the frequency stated above.

To operate the device 10 there is provided a power switching means 61 including a switch 62 mounted exteriorly of the housing means 16 and having a finger engagement portion 64 that when pressed or moved into an operative position will energize the generating means 55 and which in turn will induce vibrations by electrical energy into the crystal 50 to obtain the radial vibrations as illustrated by arrows 26. In use the female or male has placed the hair 12 wound around a particular support means 20 and if desired the complete head of the user 15 may have thereon the support members 22 with their hair kept in place by a conventional clip until activation with the ultrasonic energy.

At the point that the user is desirous of vibrating a particular support member 22, they may retain the support member 22 in a relatively fixed position with one hand, and with the other hand start the introduction of the transducer means 25 within the axial bore 32. To facilitate this axial movement relative to each other the outer surface 48 of the transducer means 25 is tapered or inclined so as to provide a shaft having an angularly disposed surface, and the inner surface 34 of the bore 32 is also tapered with the same angle of taper along the longitudinal axis of the tapered output surface 48 of the transducer means 25.

By activating the power switching means 61 contained on the housing means 16, the transducer means 25 is activated, and during this activation the user can insert the transducer means 25 therein such that the coefficient of friction therebetween is reduced as previously discussed with respect to FIG. 3 so as to obtain maximum penetration of the transducer means 25 into the support means 20 when the final coupling position illustrated in FIG. 2 is reached. In similar fashion, when withdrawal of the transducer means 25 from the support means 20 is desired, switching means 61 is activated to once again obtain the friction reduction to permit ready withdrawal from within the bore 32. Accordingly, by inclining the contacting surfaces insertion and removal is facilitated therebetween and enhanced when the ultrasonic transducer 25 is activated.

Once the transducer means 25 has been inserted into the position illustrated in FIG. 2 then the outer surface 48 is intimately engaged with the inner wall 34 for coupling the radial vibrations illustrated by arrows 26 to induce radial vibrations in support member 22 to obtain motion in the direction as illustrated by arrows 24. In this manner, as discussed above, the user may first set up their hair with a number of support members 22 which in effect are shaped like rollers or curlers that would normally be used. This permits the user to set their hair after washing it, or some other treatment, in anticipation of the ultrasonic treatment.

To facilitate the application of the ultrasonic energy, fluid supply means 65 is provided so as to supply to the hair 12 fluid to enhance the ultrasonic treatment. The fluid supply means 65 may take various shapes and forms and as illustrated in FIG. 2 is illustrated to be contained within the housing means 16 and may include a replaceable dispenser or cartridge 66 that may be mounted within the handle portion 17 of the housing means 16 and may be replaced when the contents thereof are used up. An opening not shown, may be provided for insertion and removal of the cartridge 66. The cartridge 66 may have a valve 68 extending at one end thereof with a valve stem 70 therebetween. The valve 68 may be retained in fixed position by a shoulder 72 such that angular displacement of the cartridge body 66 opens the valve 68 to permit the flow of fluid 73 therefrom. One form of activation is by providing a coupling arm 74 extending downwardly from the switching means 61 such that simultaneously with energizing the generator means 55 by contacting finger engagement portion 62 of the switch 62 contacting arm 74 engages the outer wall of the cartridge 66 to deflect same thereby activating the valve 68 and in turn causing a flow of fluid 73.

The switching means 61 may have different positions such that it is possible to mearly activate the generator means 55 and in turn the transducer means 25 without activating the valve 68. This would be utilized for initially assembling the transducer means 25 within the support means 20. When this position is reached, as illustrated in FIG. 2, the switch 64 may be then downwardly depressed thereby activating the generating means 55 once again and simultaneously the valve head 68 to obtain the flow of fluid 73.

Cover means 75 is provided to contain the hair 12 in position during ultrasonic activation and as seen in FIG. 1, the cover means 75 extends in substantially tesescoping relationship to the support means 20. The cover means has a front end 76 that may be in alignment with the front end 30 of the support means 20 and a rear end 78 that extends adjacent an enlarged radially extending flange 79 on the housing means 16 to facilitate gripping thereof by the user. The cover means includes a cover member 80 having an outer surface 82 substantially circumferentially extending around the support member 22 and terminating in spaced apart open ends 84 that are spaced from each other, as seen in FIG. 1. The distance between the open ends 84 is sufficient to permit the hair 12 of the user 15 to enter and be rolled around the support member 22 and retained in the channel 40 provided therefore. The cover member 80 includes an inner wall or surface 85 that may be outwardly tapered in conforming relationship to the outer wall 36 of the support member 22 which may be also provided with a taper to assist the insertion and removal of the cover means 75 relative to the support means 20.

To transmit the fluid 73 to the hair 12, fluid passageway means 86 is provided and may include a radially extending passageway 88 within the housing 16 and mating with a complementary passageway branch 90 that extends into a longitudinally and axially extending channeled branch 92 extending longitudinally in the cover means 75 and terminating in a plurality of fluid delivery ports 94 that terminate at the surface 85. The connection between the cover means 75 and the housing means 16 is both fluid type and such that rotational angular displacement of the cover means 75 in the direction of double headed arrow 95 is obtainable. The degree of rotation may be limited to a particular displacement to facilitate the sealed relationship hereinafter discussed, so as to permit adjustment by the user depending upon the particular position of the support member 22 on the head of the user.

The connection includes a pair of annular recesses 96 in the interior wall 98 of the cover means and a pair of annular recesses 100 in the periphery of the housing means 16 which recesses 96 and 100 respectively extend on each side of the radially extending passage 88. A pair of resilient o-rings 102 are nested in both of the recessed 96 and 100 to produce a liquid type seal therebetween. The o-rings 102 are selected of a suitable thickness and having frictional characteristics to permit rotation of the cover means 75 as illustrated by the arrow 95 relative to the housing means 16. The communicating branch passage 96 and passageway 88 extend between the o-rings 102 to permit a flow of the fluid 73 therebetween and in turn through the ports 94 to the hair 12. The number of ports 94 and their particular arrangement may vary.

The fluid supply means 65 may be provided with a variety of fluids adapted to perform various treatments to the hair 12 such as aiding in forming a permanent set, a hair bleaching agent, an agent for imparting color to the hair, a neutralizing agent, and other agents or chemicals designed to be employed and facilitate activation with ultrasonic energy.

The vibratory energy will mix or activate the fluid 73 which may act as a coupling agent to transmit the energy to the hair 12. The treatment may be further enhanced by disposing reflecting means 105 in spaced relation to the hair 12. The reflecting means 105 may be the inner wall surface 85 of the cover means 75 or may be a separate member or particular covering or coating on the cover means 75 which may be made of a plastic or other material. The reflecting means 105 reflects energy transmitted beyond the hair 12 by waves illustrated by arrows 106 in a path disposed in the direction of the hair 12 so as to obtain the further benefit or secondary treatment of deflecting the mechanical vibratory energy transmitted to the hair 12.

The transducer means 25, although illustrated of a piezeoelectric material adapted to vibrate in a radial mode, may be formed of magnetostrictive materials as well which would similarly vibrate in a radial mode. Further, if desired, the transducer means 25 may be designed such that a longitudinally disposed vibrator is rotated relative to the inner wall of the support means to progressively vibrate and excite the support means in a radial mode to obtain the same end results as hereinabove discussed.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. The method of treating hair on the human head, comprising the steps of:

A. providing a cylindrical shaped support member capable of transmitting ultrasonic vibrations in a radial mode, B. placing hair around said support member to receive vibrations transmitted by said support member, C. disposing a cover substantially around said support member, D. positioning an ultrasonic transducer adapted to produce radially directed vibrations within said support member in energy coupling relation thereto, E. supplying a treatment fluid to the hairs supported on said support member, and F. energizing said ultrasonic transducer whereby said ultrasonic vibrations are transmitted radially from said ultrasonic transducer through said support member for treatment of the hair in conjunction with said fluid with said cover substantially retaining said fluid around said support member.

2. The method as defined in claim 1, and further including the step of reflecting the mechanical vibratory energy transmitted through said support member beyond the hair for secondary treatment thereof.

3. The method as defined in claim 1, wherein said step of positioning said ultrasonic transducer within said support member includes the steps of:

a. retaining said support member in a relatively fixed position, and b. vibrating said ultrasonic transducer simultaneously during the insertion within said support member to reduce the coefficient of friction therebetween to obtain maximum acoustical coupling between said transducer and said support member.

4. The method as defined in claim 2, and further including the step of vibrating said transducer during withdrawal of said transducer from said support member.

5. The method as defined in claim 2, and further including the step of inclining the contacting surfaces of said transducer and said support member to facilitate the insertion and removal therebetween.

6. The method as defined in claim 1, wherein the radial amplitude of vibration of said support member is in the range of 0.0001 to 0.010 inch.

7. The method as defined in claim 1, and further including the step of supplying said treatment fluid through said cover.

8. The method as defined in claim 1, wherein said ultrasonic frequency of vibration is in the range of 10,000 to 1,000,000 cycles per second.

9. The method as defined in claim 1, selecting said support member to vibrate in a radial mode at the same frequency as said transducer.

10. The method of treating hair on the human head, comprising the steps of:

A. providing a cylindrical shaped support member capable of supporting and transmitting ultrasonic mechanical vibrations in a radial mode and having an axially extending bore therein, B. placing hair around said support member to receive vibrations transmitted by said support member, C. retaining said support member in a relatively fixed position, D. positioning an ultrasonic transducer in axial alignment with said base, E. inserting said ultrasonic transducer axially into said bore, F. simultaneously vibrating said ultrasonic transducer so as to effect elastic vibration thereof whereby the frictional resistance to said insertion is qualitatively reduced so that a relatively small force is necessary to obtain proper coupling relationship between said support member and said transducer, and G. energizing said ultrasonic transducer in a radial mode for transmitting radially directed vibratory energy to said support member for treatment of the hair.

11. The method as defined in claim 10, and further including the step of supplying a treatment fluid to the hairs supported on said support member.

12. The method as defined in claim 10, and further including the step of disposing a cover substantially around said support member.

13. The method as defined in claim 10, and further including the step of reflecting the mechanical vibratory energy transmitted through said support member beyond the hair for secondary treatment thereof.

14. The method as defined in claim 10, and further including the step of vibrating said transducer during withdrawal of said transducer from said support member.

15. The method as defined in claim 10, and further including the step of inclining the contacting surfaces of said transducer and said support member to facilitate the insertion and removal therebetween.

16. The method as defined in claim 10, wherein the radial amplitude of vibration of said support member is in the range of 0.0001 to 0.010 inch.

17. The method as defined in claim 10, wherein said ultrasonic frequency of vibration is in the range of 10,000 to 1,000,000 cycles per second.

18. The method as defined in claim 10, selecting said support member to vibrate in a radial mode at the same frequency as said transducer.

19. The method as defined in claim 10, and further including the steps of:

a. disposing a cover substantially around said support member, and b. supplying a treatment fluid to the hairs through said cover.

20. A portable ultrasonic device for treating hair, comprising:

A. housing means adapted to be hand held by the user of the device,

B. support means including at least one cylindrical shaped support member for positionment of the hair thereon that is adapted for receiving and transmitting ultrasonic vibrations in a radial mode, C. transducer means extending from said housing means and adapted to produce radially directed vibrations, said transducer means having an outer surface for coupling engagement with said support member to induce radial vibrations in said support member, D. cover means extending from said housing means in substantially telescoping surrounding relationship to said support member, E. fluid supply means operatively associated with said support means for applying a treatment fluid to the hair in surrounding relation to said support member so that vibration of said support member enhances the effectiveness of said treatment fluid, and F. generating means coupled to said transducer means to effect vibration of the latter at a high frequency such that said vibrations extend radially from said ultrasonic transducer through said support member for treatment of the hair.

21. A device according to claim 20, a. wherein the outer surface of said transducer means is tapered, and b. wherein the inner surface of said support member is tapered at substantially the same angle to enhance the assembly therebetween.

22. A device according to claim 21, a. wherein said outer surface is a tapered shaft, and b. wherein said inner surface is a tapered bore having the same longitudinal axis as said tapered shaft.

23. A device according to claim 20, a. wherein the outer surface of said support member is tapered, and b. wherein the inner surface of said cover means is tapered at substantially the same angle to enhance the assembly therebetween.

24. A device according to claim 20, and further including power switching means contained on said housing means and adapted to be engaged during operation of the device.

25. A device according to claim 20, wherein said cover means restrains the hair in fixed relation to said support member.

26. A device according to claim 20, wherein said transducer means includes a piezoelectric element positioned within a holder.

27. A device according to claim 20, wherein said vibration generating means is contained within said housing means.

28. A device according to claim 20, wherein said transducer means is a tubular piezoelectric element.

29. A device according to claim 20, wherein said transducer means is vibrated in the range of 10,000 to 1,000,000 cycles per second.

30. A device according to claim 20, wherein said cover means includes a passageway extending therethrough for delivering the treatment fluid onto the hair.

31. A device according to claim 20, wherein said support member includes a circumferential recess for receiving the hair therein.

32. a device according to claim 20, and further including reflecting means interposed between said cover means and said support means to reflect back into the hair the vibratory energy.

33. A device according to claim 20, wherein said support means is of a diameter to vibrate in resonance with said transducer means when acoustically coupled together.

34. A device according to claim 20, and further including means for simultaneously activating said generating means and said fluid supply means.

35. A device according to claim 20, wherein said support means is vibrated at a frequency to produce a peak acceleration of at least 1,000g so as to atomize the treatment fluid.

36. A device according to claim 20, wherein the connection between said cover means and said housing means comprises:

a. a pair of annular recesses in the periphery of said housing means, b. a pair of annular recess in the interior of said cover means, and c. a pair of resilient o-rings nested in both of said recesses to produce a liquid tight seal therebetween, said o-rings being of a suitable thickness and having frictional characteristics to permit rotation of said cover means relative to said housing means.

37. A defice according to claim 36, wherein a communicating passage extends between said o-rings to permit a flow of treatment fluid between said cover means and said fluid supply means.

38. A device according to claim 37, wherein said fluid supply means is contained in said housing means.

39. A device according to claim 20, a. wherein said cover means includes a passageway extending therethrough for delivering the treatment fluid onto the hair, b. wherein said support member includes a circumferential recess for receiving the hair therein, c. wherein said support means is of a diameter to vibrate in resonance with said transducer means when acoustically coupled together, and d. further including means for simultaneously activating said generating means and said fluid supply means.

40. A portable ultrasonic device for treating hair on the human head, comprising:

A. housing means adapted to be hand held by the user of the device,

B. support means including at least one cylindrical shaped support member for positionment of the hair thereon that is adapted for receiving and transmitting ultrasonic vibrations in a radial mode, C. transducer means extending axially from one end of said housing means and adapted to produce radially directed vibrations to induce radial vibrations in said support member, D. coupling means operatively associated with said support means and said transducer means to facilitate positionment of said transducer means in telescoping energy coupling relation with said cover means so as to obtain maximum transmission of said radial vibrations transmitted from said transducer means, and E. generating means coupled to said transducer means to effect vibration of the latter at a high frequency such that said vibrations extend radially from said ultrasonic transducer through said support member for treatment of the hair.

41. A device according to claim 40, wherein said coupling means includes:

a. an outer tapered surface on said transducer means, and b. an axially extending tapered bore having an inner surface on said support member, tapered at substantially the same angle as said transducer means to enhance the energy coupling relationship therebetween.

42. A device according to claim 41, a. wherein said outer surface is on a tapered shaft, and b. wherein said axial bore has the same longitudinal axis as said tapered shaft.

43. A device according to claim 40, and further including cover means extending from one end of said housing means in spaced relation to said transducer means for positionment in substantially telescoping surrounding relationship to said support member.

44. A device according to claim 43, and further including reflecting means interposed between said cover means and said support means to reflect back into the hair the vibratory energy.

45. a device according to claim 43, a. wherein the outer surface of said support member is tapered, and b. wherein the inner surface of said cover means is tapered at substantially the same angle to enhance the assembly therebetween.

46. A device according to claim 43, wherein said cover means restrains the hair in fixed relation to said support member.

47. a device according to claim 40, and further including fluid supply means operatively associated with said housing means for applying a treatment fluid to the hair in surrounding relation to said support member.

48. A device according to claim 47, and further including means for simultaneously activating said generating means and said fluid supply means.

49. A device according to claim 47, and further including cover means extending from one end of said housing means in spaced relation to said transducer means for positionment in substantially telescoping surrounding relationship to said support member, said cover means including a passageway communicating with said fluid supply means and terminating in a plurality of outlet ports adjacent the hair for delivering the treatment fluid thereto.

50. A device according to claim 43, wherein the connection between said cover means and said housing means comprises:

a. a pair of annular recesses in the periphery of said housing means, b. a pair of annular recess in the interior of said cover means, and c. a pair of resilient o-rings nested in both of said recesses to produce a liquid tight seal therebetween, said o-rings being of a suitable thickness and having frictional characteristics to permit rotation of said cover means relative to said housing means.

51. A device according to claim 50, wherein a communicating passage extends between said o-rings to permit a flow of treatment fluid between said cover means and said fluid supply means.

52. A device according to claim 51, wherein said fluid supply means is contained in said housing means.

53. A device according to claim 40, wherein said vibration generating means is contained within said housing means.

54. A device according to claim 40, wherein said transducer means is a tubular piezoelectric element.

55. A device according to claim 40, wherein said transducer means is vibrated in the range of 10,000 to 1,000,000 cycles per second.

56. A device according to claim 40, wherein said support member includes a circumferential recess for receiving the hair therein.

57. A device according to claim 40, wherein said support means is of a diameter to vibrate in resonance with said transducer means when acoustically coupled together.

58. A device according to claim 40, wherein said support member is manufactured from a plastic material.

59. A device according to claim 40, wherein said transducer means is ultrasonically vibrated during assembly of said support means and said transducer means to obtain optimum energy transmission through said coupling means.

60. A hair treatment support, comprising:

A. a cylindrical body portion having an outer surface for positionment of the hair in surrounding relation thereto and adapted to transmit ultrasonic vibratory energy, B. an axially extending tapered bore extending longitudinally in said body portion for receipt thereof of a complementary tapered output surface of a transducer so as to obtain maximum interfitting acoustical coupling relationship therebetween, and C. said body portion adapted to vibrate in a radial mode when excited by the transducer.

61. A hair treatment support as in claim 60, wherein said body portion is adapted to be vibrated in the range of 10,000 to 1,000,000 cycles per second.

62. A hair treatment support as in claim 60, wherein said body portion is of a diameter to vibrate at the resonant frequency of the transducer.

63. A hair treatment support as in claim 60, wherein said body portion includes a circumferential recess for receiving the hair therein.

64. A hair treatment support as in claim 60, wherein said body portion is of a plastic material.

65. A hair treatment support as in claim 60, wherein said body portion is adapted to be vibrated at a frequency to produce a peak acceleration of at least 1,000g.

* * * * *